US010508886B2

(12) United States Patent
Shimek

(10) Patent No.: US 10,508,886 B2
(45) Date of Patent: Dec. 17, 2019

(54) HOLSTER SUPPORT WITH COLLAPSIBLE STABILITY BAR FOR PROVIDING BED-SIDE OR CHAIR-SIDE SUPPORT OF A HANDGUN HOLSTER FOR RAPID AND SAFE ACCESS TO A HANDGUN

(71) Applicant: George J. Shimek, Fort Pierce, FL (US)

(72) Inventor: George J. Shimek, Fort Pierce, FL (US)

( * ) Notice: Subject to any disclaimer, the term of this patent is extended or adjusted under 35 U.S.C. 154(b) by 333 days.

(21) Appl. No.: 15/464,508

(22) Filed: Mar. 21, 2017

(65) Prior Publication Data

US 2018/0274882 A1 Sep. 27, 2018

(51) Int. Cl.
*F41C 33/04* (2006.01)
*A47C 21/00* (2006.01)

(52) U.S. Cl.
CPC ..... *F41C 33/041* (2013.01); *A47C 21/00* (2013.01)

(58) Field of Classification Search
CPC .. F41C 33/041; F41C 33/02–045; A47C 7/62; A47C 21/00–08; A47C 17/86; Y10S 224/911; Y10S 224/912; A45F 2200/0566; A47B 81/005; Y10T 24/1394; B65D 1/24
USPC ..... D6/552; 42/94, 90, 1.09
See application file for complete search history.

(56) References Cited

U.S. PATENT DOCUMENTS 3,290,701 A * 12/1966 Luff ..... A47C 21/08 5/426
4,461,442 A * 7/1984 Keenan ..... A47C 21/00 248/205.1
4,691,396 A * 9/1987 Hoffman ..... A47C 21/00 211/64
D359,439 S * 6/1995 Osbern ..... D8/354
5,685,104 A * 11/1997 Breazeale, Jr. ..... F41A 23/02 248/287.1
8,074,477 B1 * 12/2011 Weiche ..... F41C 33/06 211/64
8,479,331 B2 * 7/2013 Craighead ..... F41C 33/041 5/503.1
8,800,079 B1 * 8/2014 Eubank ..... A47C 21/026 5/424
9,387,141 B1 * 7/2016 Flannery ..... A61G 7/0507
2007/0089242 A1 * 4/2007 Battiston ..... A47C 21/08 5/662
2012/0006967 A1 * 1/2012 Bonk ..... A47C 21/00 248/674
2016/0209165 A1 * 7/2016 Karcher ..... F41C 33/048

* cited by examiner

*Primary Examiner* — Robert G Santos
*Assistant Examiner* — Myles A Throop
(74) *Attorney, Agent, or Firm* — Russ Weinzimmer & Associates, P.C.

(57) ABSTRACT

A bedside or chairside holster support for safely supporting a handgun in its holster on the side of a bed, or on the side of a chair or sofa, to provide rapid access to the handgun. The holster support includes a holster support bracket, and a T-shaped member that is held trapped between a mattress and a box spring, or under the seat cushion of a chair or sofa. The holster support maintains a handgun in a holster pointed downward at an angle of 15 degrees from straight downward for rapid access to the firearm, while keeping the muzzle of the handgun pointed in a safe direction. The holster support can be easily stored anywhere, and can be easily packed in a suitcase for travel.

16 Claims, 5 Drawing Sheets

HOLSTER SUPPORT WITH COLLAPSIBLE STABILITY BAR FOR PROVIDING BED-SIDE OR CHAIR-SIDE SUPPORT OF A HANDGUN HOLSTER FOR RAPID AND SAFE ACCESS TO A HANDGUN

FIELD OF THE INVENTION

This invention relates generally to handgun holsters, and more particularly to holster supports for making a handgun more accessible.

BACKGROUND OF INVENTION

There are home invasions and other crimes every day, and every day someone gets shot. Many such crimes occur at night while people are resting in bed. In such an environment, instant and safe access to a firearm while in bed at home or while traveling would be advantageous.

A handgun stored in the drawer of a nightstand requires at least two or three seconds to access, which can be a long time in an emergency. A handgun hidden under one's pillow can be very dangerous.

Mattress mountable supports for gun holsters are known. For example, Craighead, U.S. Pat. No. 8,479,331 teaches a mattress mountable handgun holster that includes a plate that must be inserted between a mattress and an underlying box spring, and a second plate that is attached to the first plate. The second plate hangs downward while presenting loop material on an outward-facing surface so a holster bearing hook material can be attached at any orientation to the downward hanging plate. However, the holster can be attached an orientation that can result in the handgun inadvertently falling out of the holster. Further, the plate inserted between the mattress and the box spring can be accidentally pulled out from between the mattress and the box spring when drawing the gun from the holster from certain angles of draw.

SUMMARY OF INVENTION

The Holster Support of the invention places a handgun where one's hand can easily reach down along the side of the bed when one is resting in bed. When the bed is neatly covered with a top sheet and a blanket, for example, the handgun, the holster, and the holster support are all concealed by the sheet and the blanket. If one has an urgent need to draw the gun from the holster when an intruder enters your home, precious seconds count.

The Holster Support of the invention also provides enhanced safety by ensuring that a gun in a holster supported by the holster support guarantees that the muzzle of the gun is always pointed in a safe direction, i.e., downward towards the floor at a fixed angle.

The Holster Support can be easily disassembled in less than five seconds, and can be packed away to travel for use anywhere one goes.

The Holster Support supports a holster for a handgun to provide immediate access while in bed or while sitting in a chair or sofa with removable cushions.

A general aspect of the invention is a holster support for bed-side or chair-side support of a handgun holster, the holster support including: a T-shaped member; and a holster support bracket, connected to the T-shaped member, the holster support bracket configured to support a holster at a downward direction, thereby facilitating smooth and easy access to a handgun in the holster, while ensuring that the muzzle of the handgun is directed safely towards the floor.

In some embodiments, the holster support bracket is configured to support the holster at an angle of 15 degrees from horizontal.

In some embodiments, the T-shaped member includes two tubular members, attached to each other in right angle relationship. In further embodiments, a first tubular member has a perpendicular 1½" long by ⅝" diameter shaft the center of the first tubular member configured to attach a second tubular member in perpendicular relationship. In further embodiments, each tubular member is 12 inches long.

In some embodiments, the T-shaped member is made from one of: aluminum, plastic, wood.

In some embodiments, the T-shaped member is configured to be disassembled and re-assembled.

In some embodiments, the holster support bracket is made from one of: stainless steel, aluminum, polycarbonate, carbon fiber composite.

In some embodiments, the holster support bracket includes: a formed 1½" wide band; and a perpendicular 1½" long by ⅝" diameter shaft secured centrally to the back of the formed band. In further embodiments, the formed band is formed as an open folded band configured to receive the clip of a holster. In other further embodiments, the formed band is formed as a flattened D-shaped band with an opening configured to receive a clip of a holster.

Another general aspect of the invention is a holster support for a handgun holster at bed-side or chair-side, this support including: a T-shaped tubular member; a holster support bracket configured to support a holster for holding a handgun pointed downward at an angle 15 degrees from straight down so as to maintain the handgun pointed in a safe direction until it is accessed.

In some embodiments, the T-shaped tubular member is made from two 12" tubular pieces. In further embodiments, one tubular piece has a perpendicular tube connector secured centrally, the perpendicular tube connector being configured to attach to the other tubular piece in a T-shaped fashion.

In some embodiments, the holster support bracket is a band formed as one of: a flattened C shape, or a flattened D shape. In further embodiments, the band has a perpendicular tube connector that is a ⅝" diameter shaft that is 1½" long and is centrally secured to an inner portion of the band.

In some embodiments, the holster support further includes a cotter pin, the cotter pin being used to secure the T-shaped member to the holster bracket.

In some embodiments, the two 12" tubular pieces are attached using a cotter pin so as to form the T-shaped tubular member.

In some embodiments, the holster support bracket is made from one of: stainless steel, aluminum, polycarbonate, carbon fiber composite.

In some embodiments, the T-shaped member is made using at least one of: aluminum, plastic, wood.

BRIEF DESCRIPTION OF THE DRAWINGS

Many additional features and advantages of the present invention will become apparent from reading the following detailed description when considered in conjunction with the accompanying figures, wherein.

DETAILED DESCRIPTION

Figure 1:
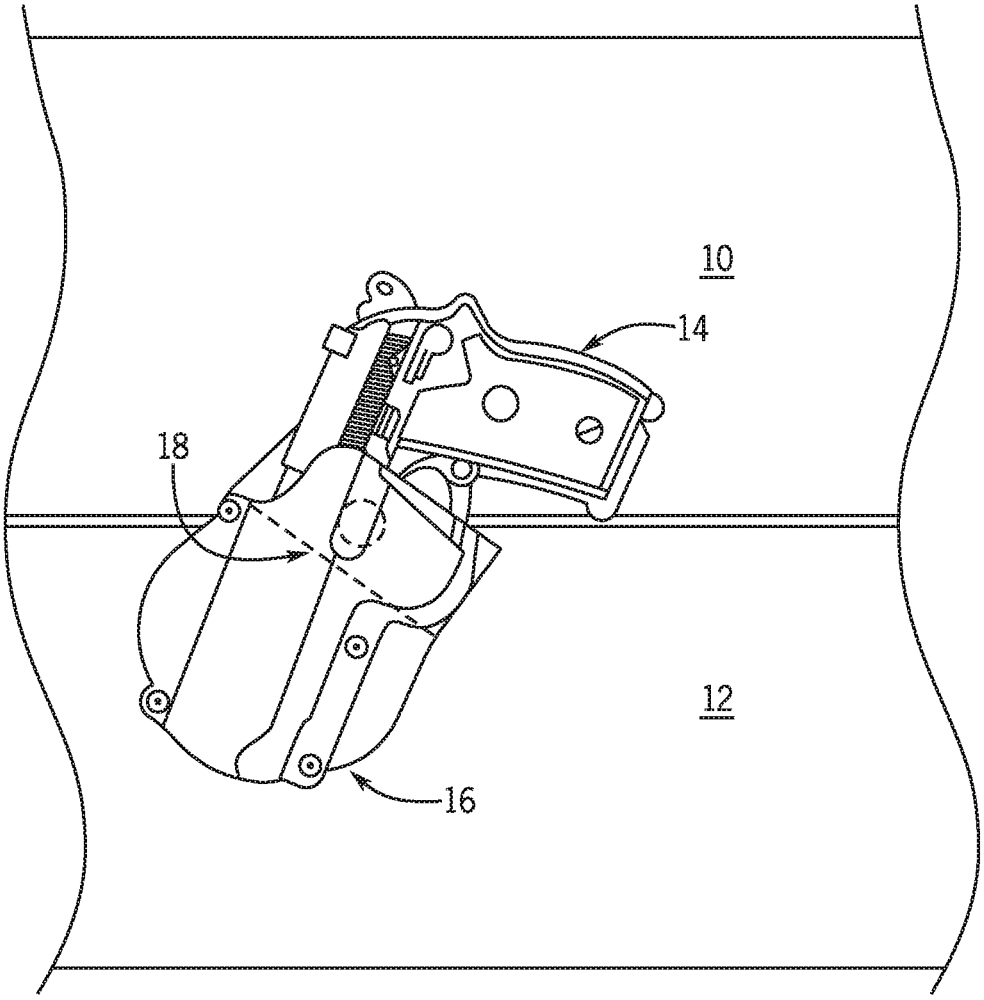
FIG. 1 is a side view of a handgun in a holster supported by the holster support of the invention, a portion of the holster support being trapped between a mattress and a box spring of a bed.

Referring to FIG. 1, a mattress 10 and supporting box spring 12 are shown, which together support a handgun 14 inserted into a holster 16 supported by the holster support 18 (shown in dotted line). A variety of brands of holsters can be utilized.

Figure 2:
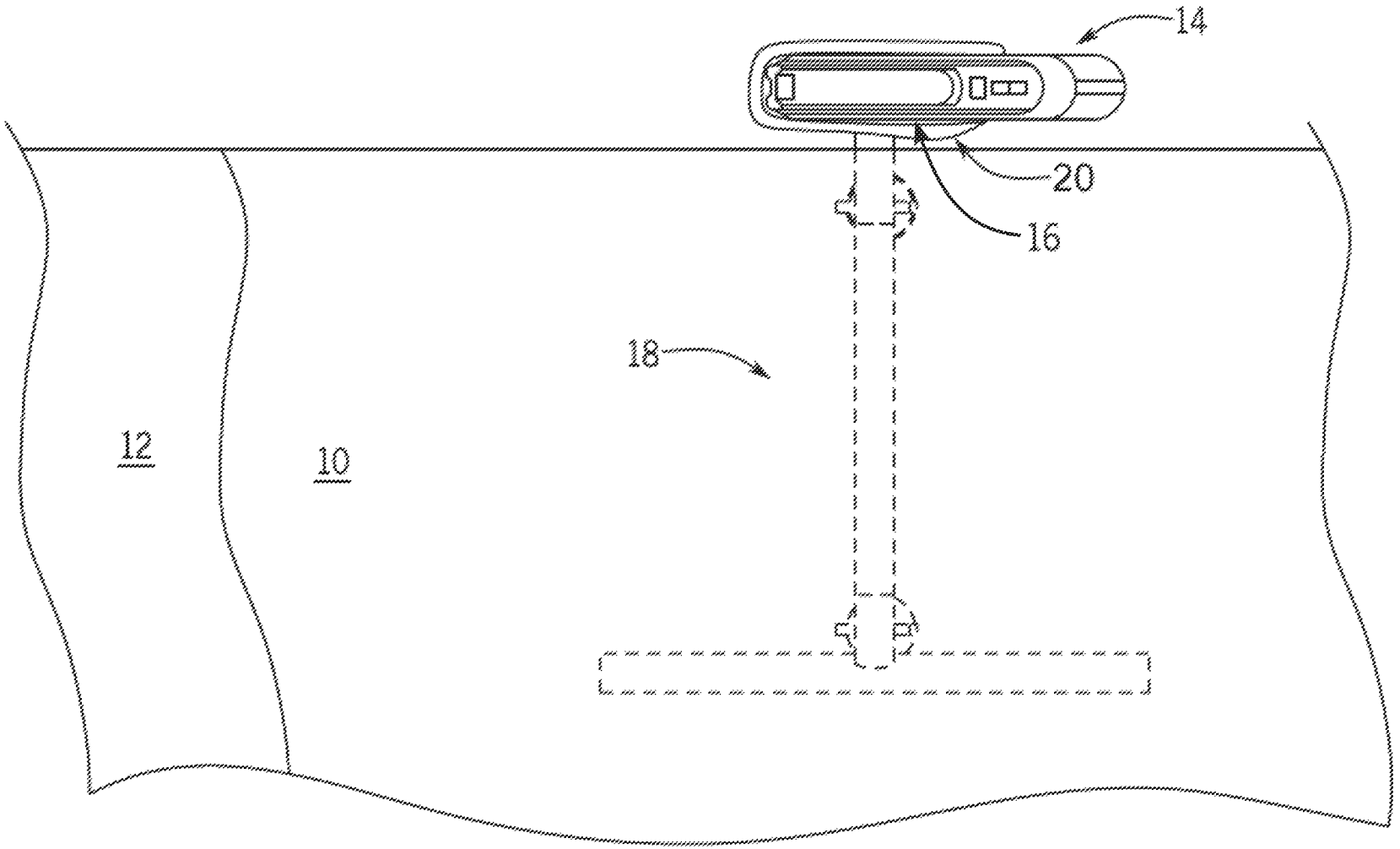
FIG. 2 is a top view of the handgun in the holster of FIG. 1, showing the T-shaped member of the holster support in dotted line, the T-shaped member of the holster support extending under the mattress.

With reference to FIG. 2 the handgun 14 is shown again, inserted into the holster 16, which is supported by the holster support bracket 20 of the holster support 18 (the portion of the holster support 18 that is trapped between the mattress 10 and the box spring 12 is shown in dotted line).

Figure 3:
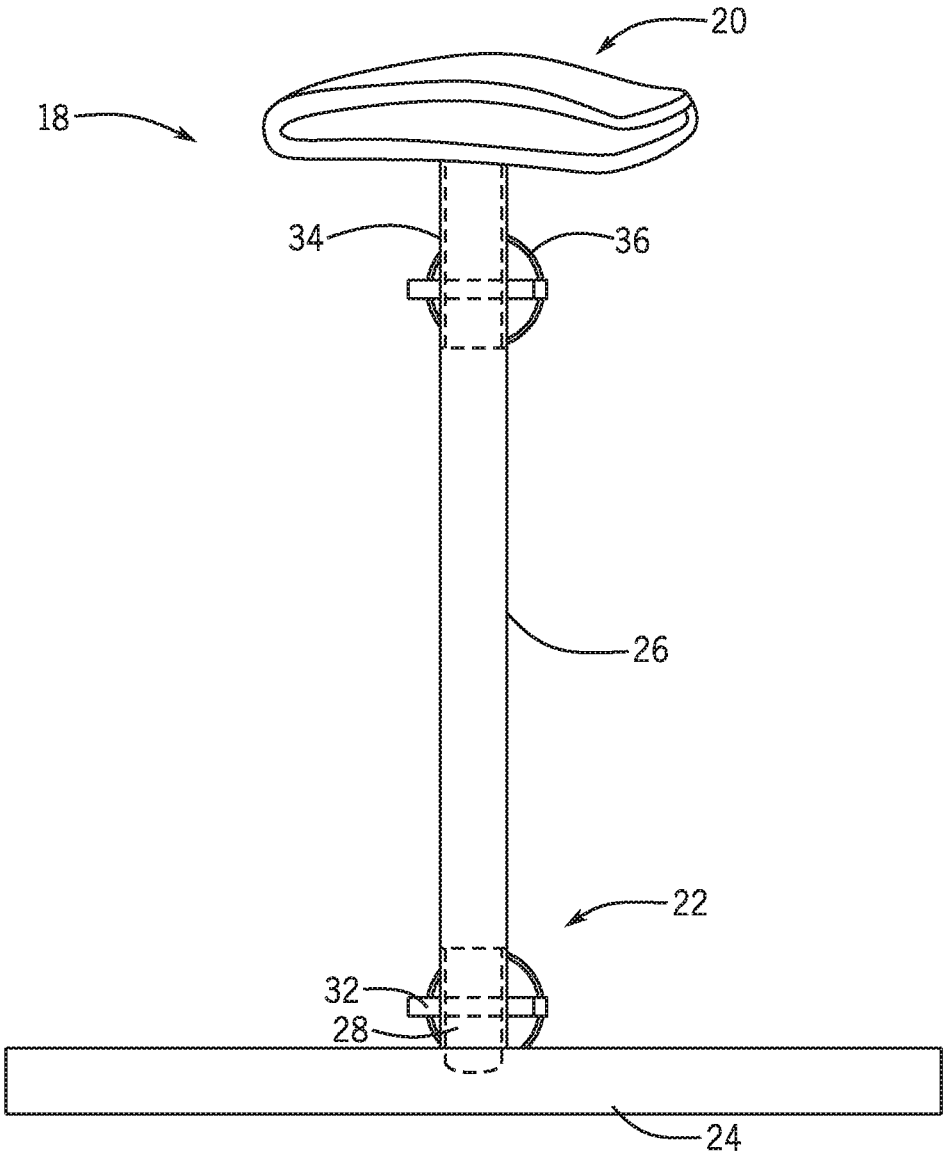
FIG. 3 is top view of just the holster support of FIG. 2, showing the parts of the holster support, assembled.

Referring to FIG. 3, the holster support 18 is shown without the handgun 14 and without the holster 16. The holster support 18 includes a holster support bracket 20 and a T-shaped member 22. The holster support bracket 20 is connected to the T-shaped member 22. The holster support bracket 20 configured to support a holster 16 at a downward direction, thereby facilitating smooth and easy access to a handgun 14 in the holster 16, while ensuring that the muzzle of the handgun 14 is directed safely towards the floor under or supporting the box spring 10.

The T-shaped member 22 includes two tubular members 24 and 26, attached to each other in right angle relationship. The tubular members 24 and 26 are equal length. The tubular member 24 has a perpendicular shaft 28 secured at the center that will mate to the other tubular member 26 so as to form a T-shape. The perpendicular shaft 28 has a hole 30 (FIG. 4) therethrough that receives a retaining pin 32. The tubular members 24 and 26 are attached to each other in right angle relationship by inserting the retaining pin 32 through the hole 34 (FIG. 4) in the tubular member 26, and through a hole 30 (FIG. 4) in the perpendicular shaft 28 of the tubular member 24.

The holster support bracket 20 is formed to retain holster at a 15 degree angle from horizontal for safe and easy access to the handgun 14. The holster support bracket 20 is a modified D-shaped clip that can function with a variety of holsters, and has an opening that is angled upward so that the holster 16 cannot fall out.

A perpendicular shaft 34 is secured to the rear of the holster support bracket 20 that is configured to mate with the tubular member 26 of the T-shaped member 22. The perpendicular shaft 34 is connected to the tubular member 26 using a retaining pin 36 though a hole 38 in the tubular member 26 and through a hole 40 in the perpendicular shaft 34. The retaining pin 32 has a pull rig 33, and the retaining pin 36 has a pull ring 37, the pull rings 33, 37 being used to pull the respective pin from the respective hole when disassembling the device 18.

The assembled device 18 can be deployed by inserting the T-shaped member 22 between the mattress 12 and the box spring 10, or between the cushions of a chair or sofa.

Figure 4:
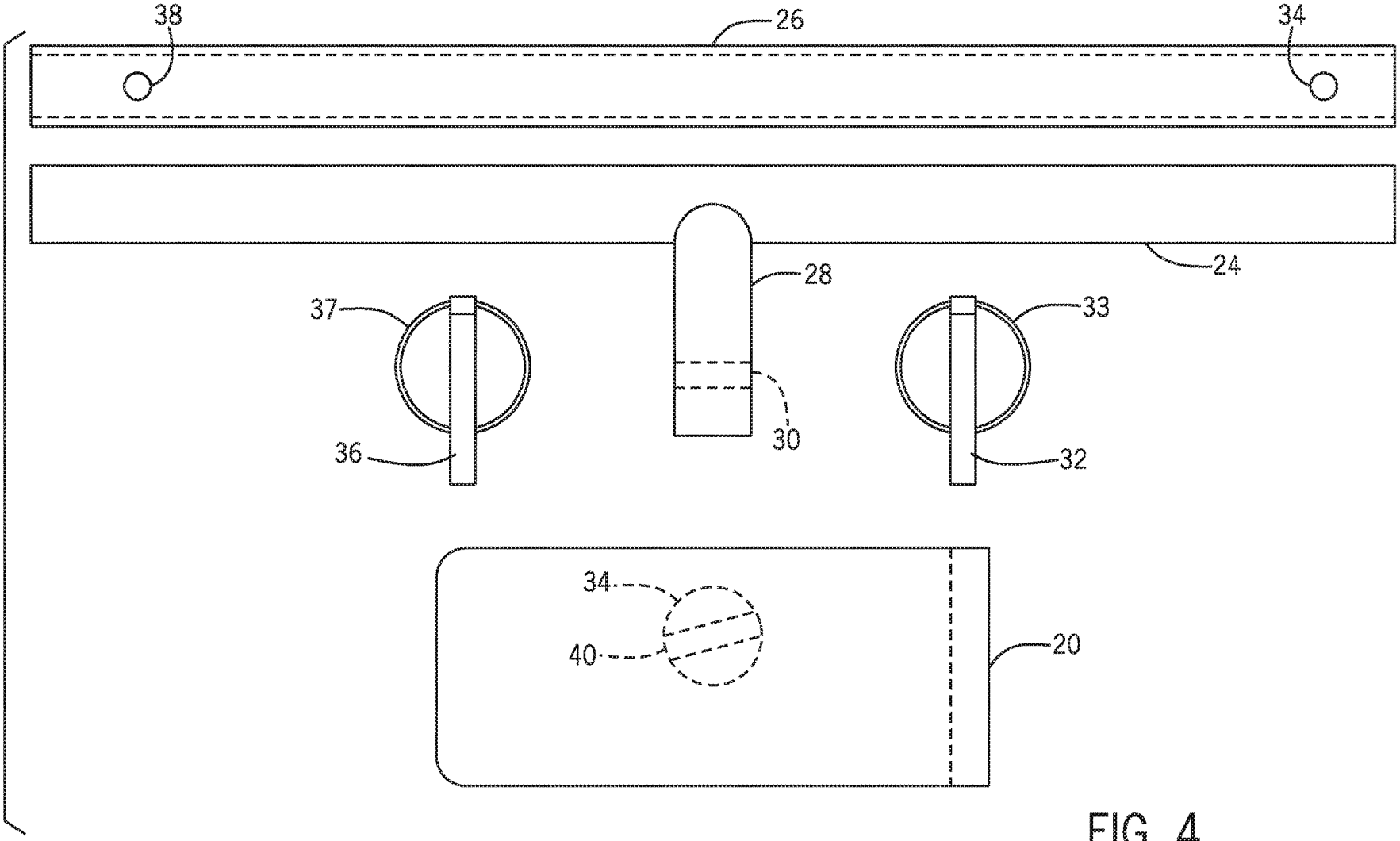
FIG. 4 is top view of just the holster support of FIG. 2, showing the parts of the holster support, disassembled.

Referring to FIG. 4, there is shown a drawing of the disassembled device 18 of FIG. 3. The tubular members 26 and 24 are shown. The two retaining pins 36 and 32 are shown. The holster support bracket 20 is shown.

In preferred embodiments, the tubular members 26 and 24 are each 12" long, ¾ inch diameter pieces of tubing. The tubing can be made of aluminum, steel, PVC, fiberglass, or carbon composite material.

The holster support bracket 20 can be fabricated from metal, such as aluminum or stainless steel. Polycarbonate or carbon fiber can also be used. The holster support bracket 20 is 1¾" wide by approximately 0.70 mm thick and 8¼" long. The first bend is on an end of the stock ¼" long, ¼" radius 90 degree bend. The next bend would be at an opposite end, and is ¼" long at the end and then a slight ½" radius of about 15 degrees. The next bend is a slight arc or bend for spring retention when the last bend is made. The last bend is made perpendicular to the length of the stock 3.75" from the first bend. Finish the bend with a bend of approximately ¼" radius. When the bend is complete there should be approximately ½" clearance.

A ⅝" diameter solid shaft 34 that is 1½ long is secured to the center of the flat backside of the holster support bracket 20. A hole 40 for the retaining pin 36 is drilled through the shaft 34. The hole 38 in the tube 26 is a ¼" hole and is drilled perpendicular to the tubing ¾" from the end tube 26. The second hole 34 in the tube 26 is the same diameter and goes at opposite end, and goes through both tubing 26 and through the solid shaft 34 of the holster support bracket 20.

Figure 5:
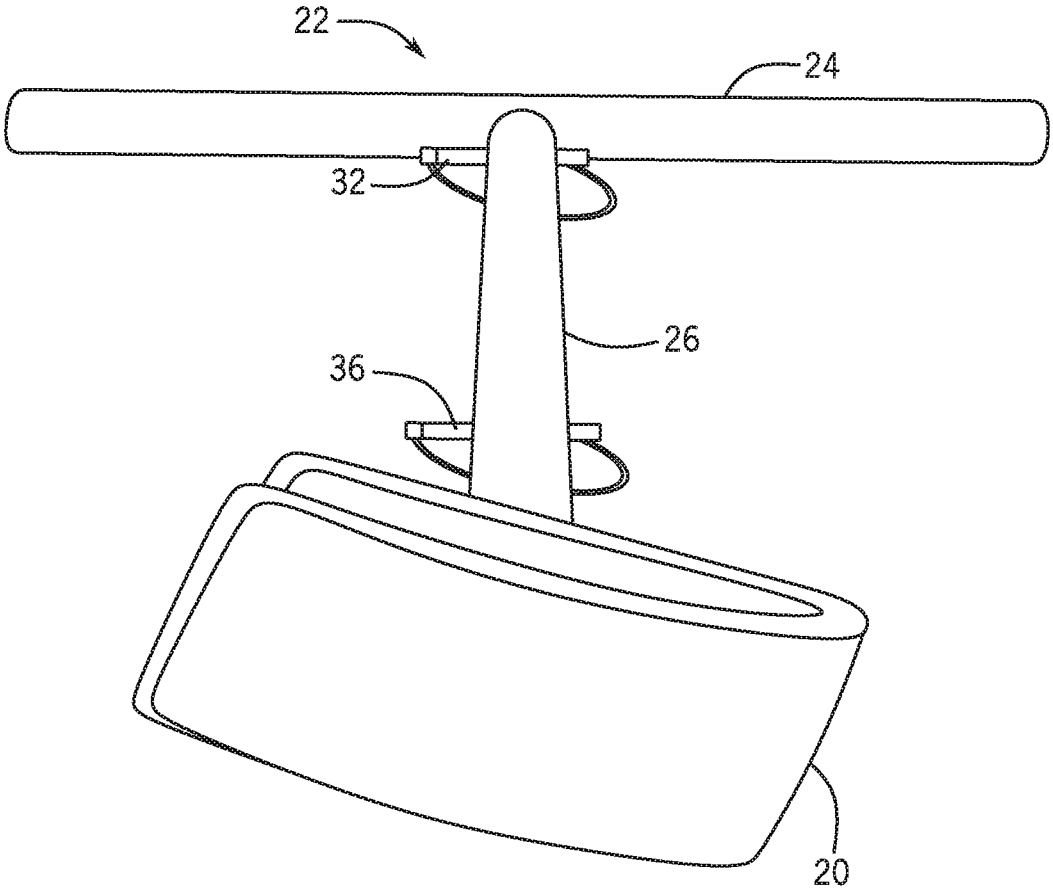
FIG. 5 is an orthographic side view of just the holster support shown in FIG. 1.

Referring to FIG. 5, lay the assembled T-shaped member 22 with retaining pin 36 on horizontal surface. Insert the holster support bracket 20 into the tubular member 26 completely, then remembering that the right side of the holster support bracket 20 should face toward the foot of bed, and should be angled upward at a 15 degree angle from horizontal. Then, insert pin 36, and push the T-shaped member 22 between the mattress 12 and box spring 10, and insert the firearm 14 into the holster 16. Then, access the firearm 14 safely and rapidly, as needed.

To make the device 18 suitable for use on the opposite side of the bed, remove pin 36, rotate the holster support bracket 20 by 180 degrees, and re-insert the pin 36.

Other modifications and implementations will occur to those skilled in the art without departing from the spirit and the scope of the invention as claimed. Accordingly, the above description is not intended to limit the invention, except as indicated in the following claims.

What is claimed is:

1. A holster support for bed-side or chair-side support of a handgun holster having a clip, the holster support comprising:

a T-shaped member, the T-shaped member including two tubular members attached to each other in right angle relationship, a first tubular member having a perpendicular 1½" long shaft secured at the center of the first tubular member configured to attach a second tubular member in perpendicular relationship; and a holster support bracket, connected to the T-shaped member, the holster support bracket configured to support a holster having a clip at a downward direction, thereby facilitating smooth and easy access to a handgun in the holster, while ensuring that the muzzle of the handgun is directed safely towards the floor.

2. The holster support of claim 1, wherein the holster support bracket is configured to support the holster at an angle of 15 degrees from horizontal.

3. The holster support of claim 1, wherein each tubular member is 12 inches long.

4. The holster support of claim 1, wherein the T-shaped member is made from one of: aluminum, plastic, wood.

5. The holster support of claim 1, wherein the T-shaped member is configured to be disassembled and re-assembled.

6. The holster support of claim 1, wherein the holster support bracket is made from one of: stainless steel, aluminum, polycarbonate, carbon fiber composite.

7. The holster support of claim 1, wherein the holster support bracket includes:

a formed 1½" wide band folded so as to form a front and a back; and a perpendicular 1½" long by ⅝" diameter shaft secured centrally to either the front or the back of the formed 1½" wide band.

8. The holster support of claim 7, wherein the formed 1½" wide band is formed as an open folded band configured to receive the clip of the holster.

9. The holster support of claim 7, wherein the formed 1½" wide band is formed as a flattened D-shaped band with an opening configured to receive the clip of the holster.

10. A holster support for a handgun holster having a clip at bedside or chair-side, the support comprising:

a T-shaped tubular member, the T-shaped tubular member being made from two 12" tubular pieces, wherein one 12" tubular piece of the two 12" tubular pieces has a perpendicular tube connector secured centrally, the perpendicular tube connector being configured to attach to another 12" tubular piece of the two 12" tubular pieces in a T-shaped fashion; and a holster support bracket configured to support a holster having a clip for holding a handgun pointed downward at an angle 15 degrees from straight down so as to maintain the handgun pointed in a safe direction until it is accessed.

11. The holster support of claim 10, wherein the holster support bracket is a band formed as one of: a flattened C shape, or a flattened D shape.

12. The holster support of claim 11, wherein the band has a perpendicular tube connector that is a ⅝" diameter shaft that is 1½ long and is centrally secured to an inner portion of the band.

13. The holster support of claim 10, wherein the two 12" tubular pieces are attached using a cotter pin so as to form the T-shaped tubular member.

14. The holster support of claim 10, wherein the holster support bracket is made from one of: stainless steel, aluminum, polycarbonate, carbon fiber composite.

15. The holster support of claim 10, wherein the T-shaped member is made using at least one of: aluminum, plastic, wood.

16. The holster support of claim 10, further including a cotter pin, the cotter pin being used to secure the T-shaped tubular member to the holster support bracket.

* * * * *